US006168483B1

(12) United States Patent
McIntosh

(10) Patent No.: US 6,168,483 B1
(45) Date of Patent: Jan. 2, 2001

(54) DEFECTING PROPELLER GUARD

(76) Inventor: Paul C. McIntosh, P.O. Box 685, Mount Vernon, WA (US) 98273

( * ) Notice: Under 35 U.S.C. 154(b), the term of this patent shall be extended for 0 days.

(21) Appl. No.: 09/418,103

(22) Filed: Oct. 14, 1999

Related U.S. Application Data

(60) Provisional application No. 60/109,862, filed on Nov. 24, 1998.

(51) Int. Cl.[7] ..... B63H 5/16
(52) U.S. Cl. ..... 440/71
(58) Field of Search ..... 440/66, 71, 72, 440/73

(56) References Cited

U.S. PATENT DOCUMENTS

| | | | |
|---|---|---|---|
| 2,355,842 | 8/1944 | Arado . | |
| 2,717,570 | 9/1955 | Willoughby | 440/71 |
| 4,096,819 | 6/1978 | Evinrude . | |
| 4,680,017 | 7/1987 | Eller | 440/72 |
| 4,925,412 | 5/1990 | Karls | 440/71 |
| 5,007,869 | 4/1991 | Zoellner | 440/71 |
| 5,017,165 | 5/1991 | Havins | 440/71 |
| 5,176,550 | 1/1993 | Hooper | 440/72 |
| 5,178,565 | 1/1993 | Jacobson | 440/71 |
| 5,207,605 * | 5/1993 | Kroeber | 440/71 |
| 5,224,889 * | 7/1993 | Hickey | 440/71 |
| 5,470,262 | 11/1995 | Bustillo, Sr. | 440/72 |

* cited by examiner

*Primary Examiner*—Jesus D. Sotelo
(74) *Attorney, Agent, or Firm*—Robert B. Hughes; Hughes & Schacht, P.S.

(57) ABSTRACT

A deflecting propeller guard comprising a pair of adjacent deflector plates slanting downwardly and rearwardly from a front apex location to provide downwardly and laterally facing deflection surfaces. There is a rear guard section having two guard plates positioned adjacent to one another and extending outwardly and upwardly at a moderate slant from a center axis. The deflecting propeller guard is positioned with the guard section below the propeller and the deflecting section forwardly of the propeller. A center mounting plate is provided to be positioned adjacent to, and connected to the skeg of the motor assembly.

19 Claims, 4 Drawing Sheets

DEFECTING PROPELLER GUARD

This application claims benefit to provisional application 60/109,862 filing date Nov. 24, 1998.

BACKGROUND OF THE INVENTION

A) Field of the Invention

The present invention relates to a method and apparatus for protecting a boat propeller, and more particularly to such an apparatus and method which in addition perform a deflecting function and provides other advantageous features.

BACKGROUND ART

Powerboats often find themselves in shallow water and possibly encounter obstacles which extend upwardly from the underwater surface. In other instances, when the boat is simply operating in quite shallow water, the propeller is apt to come into contact with a sandy or muddy river or lake bottom. In either case, this can result in damage to the propeller.

It is an object of the present invention to provide a deflector propeller guard and method for a boat propeller assembly, with a balance of desirable features. More specifically, the present invention provides a protective apparatus which also serves a deflecting function to cause objects or underwater surface material (e.g. dirt, sand, etc.) to be deflected away from the propeller in a manner to alleviate to some extent the impact of such objects and/or material, and also move such objects or material out of the path of the propeller.

Also, it is an object of the present invention to structure the guard apparatus so that it is durable, sturdy, and yet can be economically and conveniently manufactured.

Also, the present invention is particularly adapted to be mounted to a propeller section of a motor where the propeller section has a skeg which extends downwardly from a propeller housing.

SUMMARY OF THE INVENTION

The protection and deflection apparatus of the present invention is adapted to be mounted in an operating position adjacent to a propeller section of a boat. The propeller section has a propeller blade portion having an axis of rotation in an outer circumferential path of rotation along which tip portions of the propeller blade portion travel. The apparatus has a longitudinal axis, a transverse axis and a vertical axis.

The apparatus comprises a forward deflecting section having a forward deflecting axis which extends in a downward and rearward slant. This forward deflecting section comprises right and left deflection plates, each of which comprises:

i) a central deflection edge portion, with the two connecting deflection edge portions joining one another at said deflecting axis;

ii) an outer deflection edge portion, with the two outer deflection edge portions each having a forward end and a rear end, and extending laterally outwardly and downwardly from the forward end of the deflection plate;

iii) a rear deflection section connecting portion;

iv) a generally downwardly and outwardly facing deflection surface, with the two deflection surfaces forming an angle of less than 180 degrees, relative to a plane taken perpendicular to said deflecting alignment axis, so as to extend laterally and upwardly away from one another;

There is a rear guard section having a rear central guard section axis which is generally longitudinally aligned and is at an angle of less than 180 degrees relative to the deflection axis. A forward end portion of the rear guard section is connected to the rear end portion of the forward deflecting section, and it also has a rear end. The guard section comprises right and left guard plates, each of which comprises:

i) a central guard plate connecting edge portion with the two central guard plates connecting edge portions meeting each other at the central guard section axis;

ii) a laterally outward section edge portion having a forward end and a rear end;

iii) a forward guard section connecting portion connected to the rear deflection connecting portion of its related right or left deflection plate;

iv) a generally downwardly and outwardly facing lower guard surface, with the two guard surfaces forming an angle of less than 180 degrees, relative to a plane taken perpendicular to the guard section axis.

Also, in the preferred form the apparatus comprises a mounting section by which the apparatus can be mounted in the operating position. More specifically, in the preferred form this mounting section comprises at least one vertically aligned mounting member adapted to be mounted to a skeg of the propeller section. This mounting section may also comprise a backing plate which is adapted to be placed on a side of the skeg opposite to the side on which the mounting member is positioned, with one or more fasteners extending through the mounting member, the backing plate and the skeg.

The forward end portions of the downwardly facing guard surfaces of the two guard plates are aligned and adjacent to the rear end portions of the downwardly facing deflecting surfaces of the deflection plates. More specifically, in the preferred form, the forward lower surface edge portions of the guard plates are aligned with and immediately adjacent to rear surface edge portions of the deflection plates in a manner to form a continuous lower surface area of the deflection section and the guide section.

In the preferred form, the outer edges of the outer deflection edge portions of the deflection plates meet with and are aligned with forward ends of the outer edges of the guard plates.

Desirably, the angle formed by the two deflection guard surfaces is no less than about a right angle, desirably between about 160 degrees to 100 degrees, and more desirably between about 140 degrees to about 110 degrees. A preferred angle would be about two-thirds of a straight angle.

Also in the preferred form, the angle formed by the two guard surfaces would be no less than about two-thirds of a right angle. Desirably, this angle would be between 150 degrees to 175 degrees, and more desirably between 160 degrees and about 170 degrees. A preferred angle is about 165 degrees.

Also in the preferred form, the forward end portions of the downwardly facing guard surfaces slant inwardly and forwardly toward one another and form an angle between about 160 degrees to 60 degrees, more desirably between about 140 degrees to 80 degrees, and more desirably yet between 120 to 90 degrees. A preferred angle would be approximately 105 degrees.

The outer deflection edge portions of the two deflection plates form an angle between about a right angle and about one-sixth of a right angle taken from a view parallel to the longitudinal center line of the apparatus. More desirably, this angle would be between about 60 degrees to 20 degrees. A preferred angle would be about 30 degrees.

If an angle is formed by the lines resulting from a horizontal plane intersecting the two guard plates at about the longitudinal mid length thereof, these two lines extend rearwardly and outwardly from the forward central axis at an angle between about three-quarters of a straight angle and one-half of a right angle. A more preferred range is between about 110 degrees to 65 degrees, and more preferably about a right angle.

The angle formed by the central guard section axis relative to the deflection axis is desirably no less than about two-thirds of a straight angle. In the preferred form it would be no greater than 160 degrees. A preferred range would be between 150 degrees to 130 degrees. An angle of 140 degrees has been found to be satisfactory.

Also in the preferred form, there are openings formed in the deflection section, and desirably these are in the form of elongate slots, and more desirably, horizontal slots.

Also, the apparatus of the present invention can be made where the forward deflection section and the rear guard section are integrally formed from a single piece of sheet metal which is bent along bend lines to form the apparatus. The bend lines are located along the deflecting axis, along the central guard section axis, an elongate connecting line between one of the deflection plates and one of the guard plates. The other deflection plate and the other guard plate are joined together to form the unitary structure comprising the forward deflection section in the rear guard section.

In the method of the present invention, the apparatus is positioned as noted above. The deflecting section is used to accomplish the deflection function as described above, and the guard plates are utilized to perform the guard function for objects below and positioned adjacent to one side of the propeller.

Other features will become apparent from the following detailed description.

DESCRIPTION OF THE PREFERRED EMBODIMENT

Figure 1:
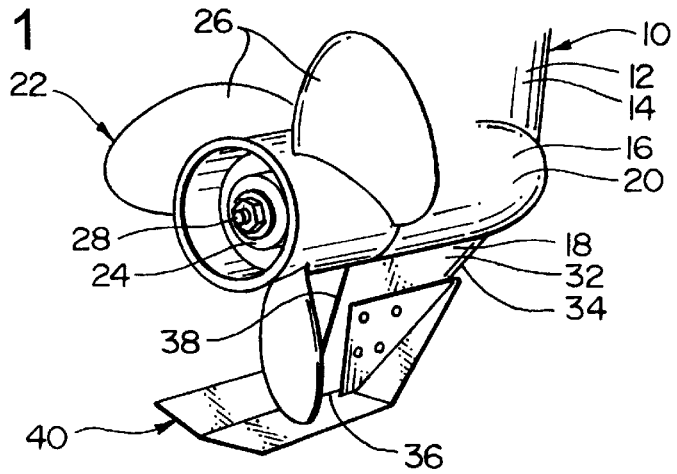
FIG. 1 is an isometric view showing the deflector propeller guard apparatus mounted to the lower end of an outboard motor.

With reference to FIG. 1, there is shown the lower portion of an outboard motor 10 (or inboard-outboard motor 10), having a motor housing 12, with a strut 14, a propeller section 16 and a skeg 18 extending downwardly from the propeller section 16. The propeller housing 16 comprises a gear housing portion 20, and there is a propeller 22 mounted about a hub 24 rotatably mounted to the housing portion 20. The propeller 22 has a plurality of blades 26 (three are shown herein), and these rotate about a central longitudinally lined propeller axis indicated generally at 28.

The skeg 18 is in the form of a vertically and longitudinally aligned plate having an upper connecting portion 32, a front edge 34 that extends downwardly and rearwardly from the gear housing 20, and also a lower generally longitudinally aligned edge 36. The skeg also has a rear edge portion 38.

The deflecting propeller guard apparatus 40 of the present invention comprises a forward deflecting section 42, a rear guard section 44, and a mounting or connecting section 46. In addition, there is a mounting or backing plate 47 which cooperates with the connecting section 46 to mount the apparatus 40 to the skeg 18.

The forward section 42 comprises a pair of deflector plates 48 which are joined to one another along a longitudinal center line 50, coincident with the central connecting edges 52 of the two plates 48. These plate sections 48 can be formed from a single piece of metal. The forward deflecting section 42 has a front apex location 54, and there are two laterally outward deflecting side edges 56 of the two deflecting plates 48, each edge 56 slanting from the apex location 54 downwardly and outwardly, to an outer end location of a related rear connecting edge 58 of that plate section 48.

The rear section 44 comprises two guard plates 60 which join to one another along a longitudinal center line 61, with the connecting edges being indicated at 62. These guard plates 60 can be formed from a single piece of sheet metal bent along the center line 61. Also the deflection plates 48 and the guard plates 60 can be made integrally from a single piece of sheet metal. This will be explained later herein.

These two plates 60 have inwardly and forwardly extending front connecting edges 64 that join to one another at a front apex location 66, and each of the connecting edges 64 joins to a related rear edges 58 of its adjacent the forward section 42. Each guard plate 60 has a longitudinally extending outer side edge 68, each of which has a rear outer rounded corner at 70. Each plate 60 also has a rear edge 72 which is perpendicular to the longitudinal axis 61.

The aforementioned connecting or mounting plate 46 has a top horizontal edge 74, a rear vertical edge 76, a relatively short lower rear horizontal edge portion 78, and a front forwardly and upwardly slanting edge 79. The front edge 79 is welded or otherwise attached to the right plate 48 immediately adjacent to the center line 51 of the two deflector plate sections 48. The lower rear edge portion 78 of the mounting plate 46 is welded or otherwise secured to the forward part of one of the central edge portions 62 of the two guard plates 60.

The aforementioned backing plate 47 has a trapezoidal configuration, with a top horizontal edge 80, a front downwardly and rearwardly slanting edge 82, a lower horizontally extending edge 84 and a rear vertically extending edge 86. The plate 47 could also have other configurations. The plate 47 is provided with a plurality of through openings 88, and these match with corresponding openings 90 formed in the mounting plate 46. As will be disclosed later herein, through openings are drilled in the skeg 18, and bolts or other securing devices are inserted through the openings 88, 90 and also the openings in the skeg 18 to mount the deflector guard 40.

Figure 4:
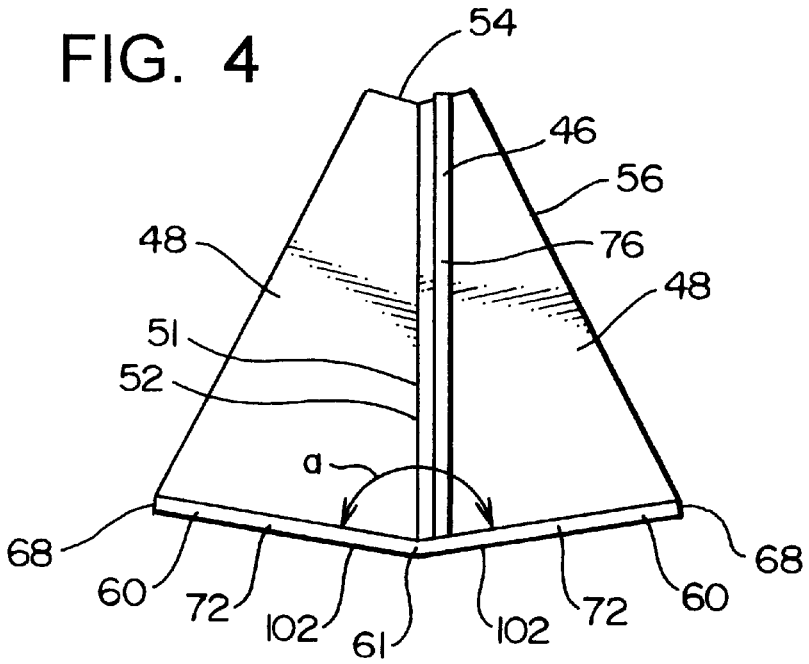
FIG. 4 is a rear elevational view thereof.

The particular shape and positioning of the components of the deflector guard 40 of the present invention are considered to be significant with respect to how these cooperate effectively to perform a number of functions. To describe this in more detail, reference is first made to FIG. 4, which is a rear elevational view looking toward the rear edge 72 of the guard plates 60. It can be seen that the two guard plates 60 slant upwardly and outwardly from the longitudinal center line 61 toward the outer edge 68. The angle (designated "a") which these two plates 60 make with one another is approximately 165 degrees. Within the broader scope of the present invention, this angle "a" should be less than 180 degrees but not less than approximately 120 degrees. Desirably, this angle "a" should be no less than 150 degrees, or possibly 160. Also, it is desirably no greater than 175 degrees or 170 degrees.

Figure 5:
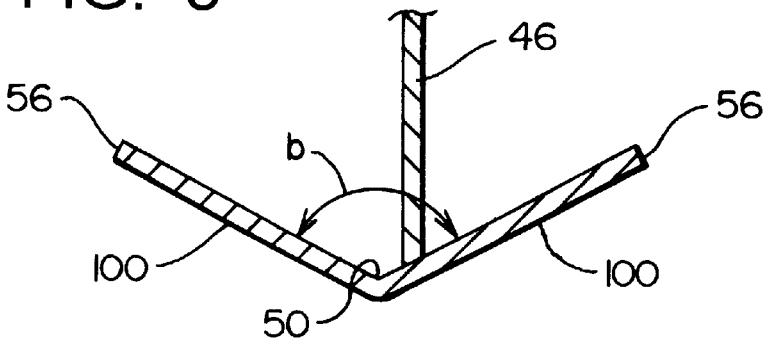
FIG. 5 is a sectional view taken along line 5—5 of FIG. 2.
Figure 6:
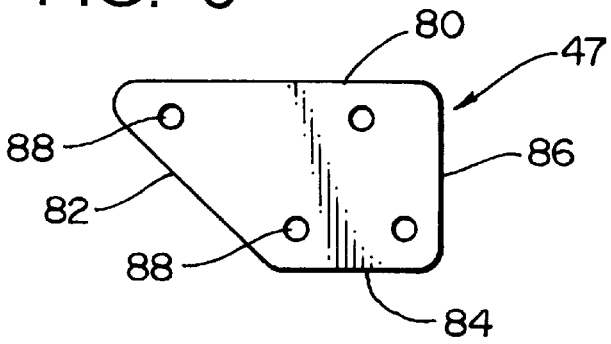
FIG. 6 shows a mounting plate used in the present invention.

With reference to FIG. 5, it can be seen that the two deflector plates 48 make an angle "b", which is about two thirds of a straight angle, and more precisely in one embodiment about 120 degrees. This angle "b" should be less than 180 degrees, and desirably not less than approximately a right angle. In the preferred configuration the angle "b" should be between about 160 to 100 degrees, and more desirably between about 140 to 110 degrees.

Figure 3:
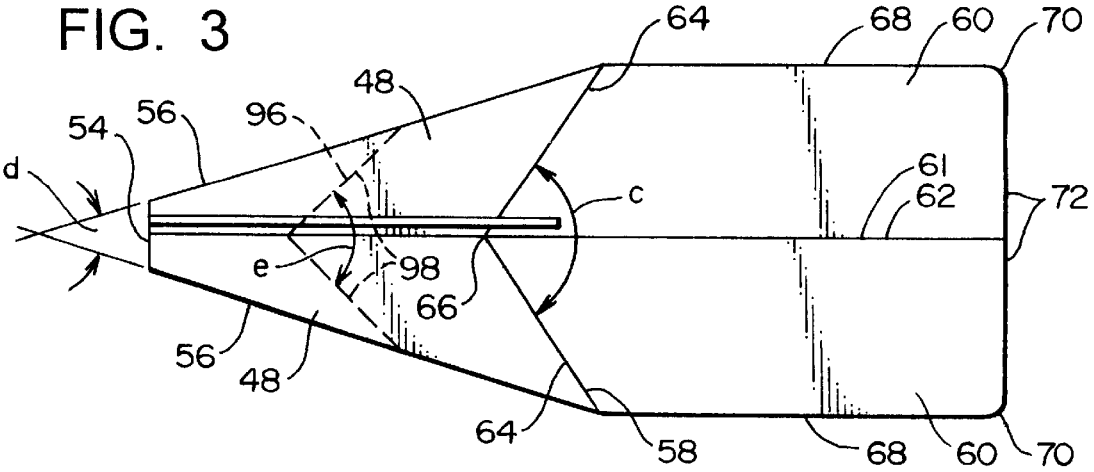
FIG. 3 is a top plan view thereof.

Also, it will be noted that the two edge portions 58 of the front plates 48 join the connecting edges 66 of the rear guard plates 60 along lines that make an angle indicated at "c" in FIG. 3. This angle "c" is, in this preferred embodiment about 105 degrees. This angle "c" should be less than 160 degrees, and no less than 60 degrees. In the preferred form, it is between about 140 and 80 degrees, and in a more preferred form between about 120 and 90 degrees.

It will also be noted that in plan view, the two side edges 56 of the deflector plates 48 form an angle, indicated at "d" in FIG. 3. In the preferred form, this angle is about one third of a right angle. Desirably, the angle should be at least as great as 15 degrees, and not greater than a right angle. More desirably, this range should be between about 20 degrees and two thirds of right angle, or about 25 degrees and 40 degrees.

With the foregoing relationships having been described, let us now review the operation of the present invention and how the various components cooperate with one another in accomplishing these functions.

First, the deflector plates 48 serve not only a guarding function, but also a deflecting function. The lower surfaces 94 of the deflector plates 48 slant rearwardly and outwardly from one another to enhance their deflecting action. To describe this more specifically, reference is made to FIG. 2, where there is at approximately the mid height of the deflector plates 48 drawn a horizontal section line 96. This same section line 96 is shown in the top plan view of FIG. 3 as the two slanting lines 98 which form an angle "e". This angular relationship exists all along the deflector plates 48. This angle "e" is shown as being about a right angle or a little bit less than the 90 degrees. This angle could possibly be as great as 135 degrees and as small as about 45 degrees, and desirably be between about 110 degrees and about 65 degrees.

Figure 2:
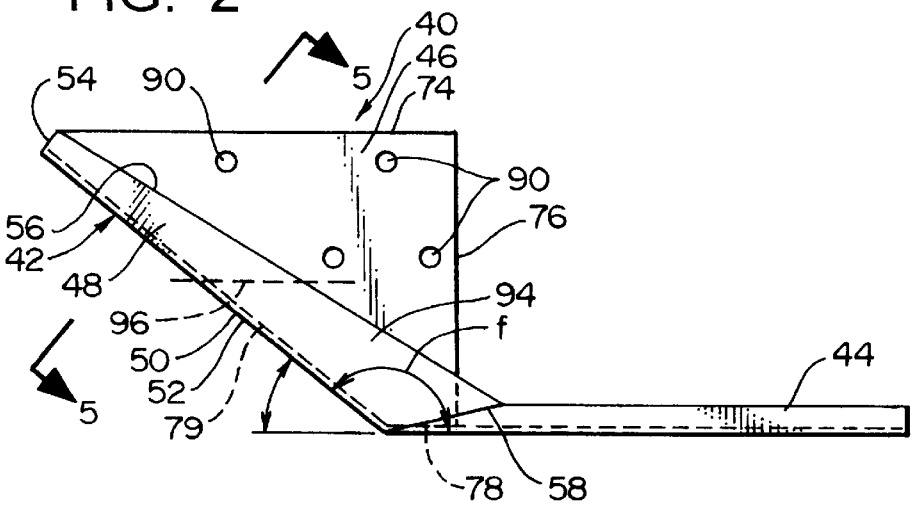
FIG. 2 is a side elevational view of the apparatus of the present invention.

The slant of the longitudinal center line of the connecting edge portions of the plate sections 48 makes an angle with a forward projection of the center line 61 of the two guard plate sections 60, and this angle is indicated at "f" in FIG. 2. In the preferred embodiment, this angle "f" is about 140 degrees, and it can range from 160 degrees to two-thirds of a straight angle. A preferred range would be between about 150 degrees to 130 degrees.

As indicated previously, it often happens that when a boat is in shallow water in a river or lake, the deflector guard 40 comes into contact with a sandy or muddy bottom. If this sandy or muddy bottom is struck or engaged by a blunt surface, or a flat surface witch is simply slanting downwardly and rearwardly, then there will be something of a "bull dozing" effect where the material piles up in front of the guard plate. This simply compounds the problem.

In the present invention, with the slope of these deflecting plates 48, two things are accomplished. First, the slant of the plates are such so that these do create a downward force component which has something of a lifting effect on the guard device 40. At the same time, there is a force component directed laterally outward which tends to deflect the sand or mud to the side. This same effect would also be accomplished when a gravel-like bottom is encountered.

It has been found that this arrangement enhances the ability of the boat to move forward in sandy, muddy or particulate material with less resistance. Also, there is a less disruptive effect on the river or lake bottom. More specifically, it sometimes happens that when the shallow bottom is encountered, something of a shallow furrow is formed, and the material is simply pushed to the side by the sloping surfaces 100.

Also, as indicated previously, the two guard plates 60 have an upward and lateral slant. The angle of this slant is such that the downward surfaces 102 functions as a continuation of the slanting front deflector plates 48. More specifically, if the central furrow is formed so that the material is deflected somewhat outwardly, as the rear section 44 passes over, the lower center edge 62 simply continues the forward travel in that furrow.

Also, with reference to FIG. 5, it will be noted that the plates 60 slant so that the plates 60 are closest to the propeller along locations spaced a short distance laterally from the bottom center portion of the circumferential path 30 of the propeller. In the event that there is a lateral component of movement at the rear end of the boat (as there often is in a turning motion), this sloped surface 102 of the guard plates would tend to ride over certain obstacles. If the edge were simply an edge of a horizontal plate, there is sometimes a tendency to dig in and actually bring various material or objects into the path of the propeller.

Also, it should be noted that the present invention is arranged in such a way so as to give it structural strength. The plates 48 and 60 are made of steel and have sufficient thickness to provide structural strength. In addition, however, the shaping of these plates 48 and 60 and also the relative position of these plates 48 and 60 give added structural strength in that these plates 48 and 60 in a way act in something in the manner of a beam to resist bending moments.

To explain this further, attention is directed to the juncture line where the edges 58 and 64 join to one another and how these relate to the deflector plates 48. Let us assume that there is an upward force exerted at an outer center location of one of the deflector plates 48. The direction in which the upward force would tend to rotate the plates 48 is such that the two edges 58 at the rear side of the deflector plates 48 and into the center edges 52 react these forces in a manner to provide greater resistance to such upward movement. This same resisting force would incur if there is an upward force exerted against one of the rear guard plates 60.

To continue the explanation, if the two plates 60 were simply parallel so that these lie on one plane, and the two plates 48 were parallel to one another, then there would only be the resistance to the plate material itself to being bent which would resist this force. However, the configuration of these plates 48 and 60 is such that the plates themselves actually act as a beam. More specifically such an upward force would tend to place the plates 60 at the location of the center line 61 in tension, and to cause the upper portions of the plates 60 (which are near the edge portion 68) to be in compression. The same is true of the plates 48. To give a simpler example of this, let us assume that there is an elongate flat metal plate, and that metal plate will bend along its length when a certain force is applied. Let us now assume a 90-degree bend is formed along the length of that plate, so that it forms a right angle in a cross sectional configuration. Now the plate becomes much stiffer in its resistance to being bent. This same effect is provided by the structure of the present invention.

To describe the operation of the present invention, the apparatus 40 is first positioned so that the mounting plate 46 is positioned adjacent to the skeg 18 in its operating position so that the openings 90 of the mounting plate 46 are aligned with matching openings in the skeg 18. Bolts or other connecting devices are inserted through the openings in the skeg 18 and the backing plate 47 is then positioned against the other side of the skeg 18 with the bolts or other connectors extending through openings 88 in the backing plate 47. Then the connectors are properly secured, such as by screwing the nuts on to the bolts.

With the deflecting and guard apparatus in its operating position, it can be seen in FIG. 1 that the forward deflecting section 42 is positioned forwardly of the propeller blades 26, and that the lower rear end portion of the deflecting section 42 is positioned below the lowermost level of the circumferential path traveled by the blades 26. Also, as can be seen in FIG. 1, the two guard plates 60 of the guard section 44 are positioned beneath the blades 26 and as shown in FIG. 1 are closely adjacent to the circumferential path 28 of the outer tips fo the blades 26. If a smaller diameter propeller is used, then, of course, the clearance between the lower guard plates 60 and the circumferential path of the propeller blades will be greater.

With the apparatus 40 in its operating position, the boat is operated in the normal manner. It has been found that with the apparatus 40 of the present invention installed, there is no noticeable adverse effect on the operation of the boat. The added benefit of the present invention is, of course, the deflecting and protective functions accomplished by the apparatus 40.

Let us assume that the boat is operating in a shallow body of water where there is a sandy or muddy lake bottom or riverbottom. It has been found that if the surface of the mud or sand is quite close to the propeller 26 so as to possibly come into contact therewith, as the boat travels into that shallow section, the downwardly and rearwardly sloping forward deflecting section 42 engages the muddy or sandy surface and lifts the motor so as to avoid contact with the muddy or sandy bottom. In addition to performing its lifting function, the deflector plates 48, meeting at the central line 50, push the sandy or surface material to the side. Then this material that has pushed aside is kept away from the propeller base 26 by the upwardly and outwardly sloping guard plate 60.

Let us now consider the situation where the load is executing a particular maneuver or is in a current where there is a lateral component added to the forward path of travel so that the boat at the location of the motor is moving sideways relative to the river or lake bottom. In this instance, if the boat encounters a shallow bottom, the guard plate which is moving laterally into the material at the lake or river bottom, because of its lateral and upward slope, tends to move the apparatus 40 upwardly and thus avoid the contact of the propeller with the river or lake bottom.

Let us now consider the situation where there is an underground obstruction in the water, such as a rock, a log, or some other object. The slope of the deflector section 42 enables the apparatus 40 to move up over the obstruction, possibly move the obstruction aside, or even cause a deflection of the apparatus 40 itself upwardly and sideways to avoid the contact with the object (assuming that the object is difficult to move). In this regard, it should also be noted that (as indicated previously in this text), the manner in which the front and rear sections 42 and 44 are configured with one another gives added strength to the overall structure of the apparatus 40, thus enabling it to withstand the impact of the forces that may be imparted to the apparatus 45 coming into contact with some shallow stationary object.

Figure 7:
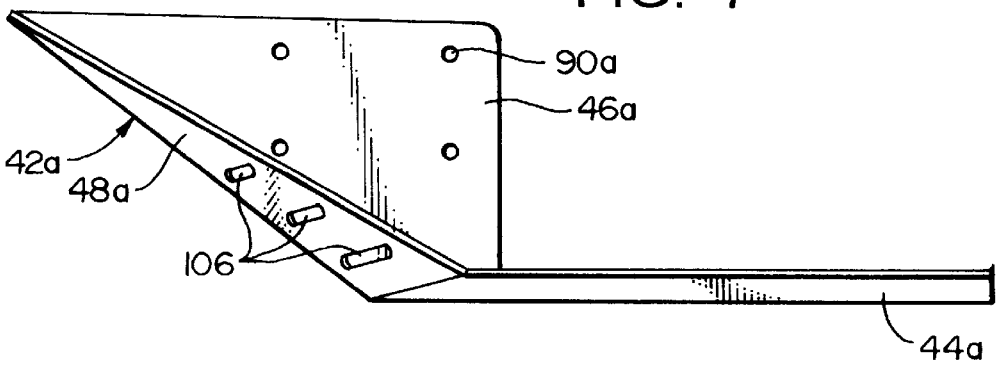
FIG. 7 is a side elevational view, similar to FIG. 2, showing a second embodiment of the present invention.
Figure 8:
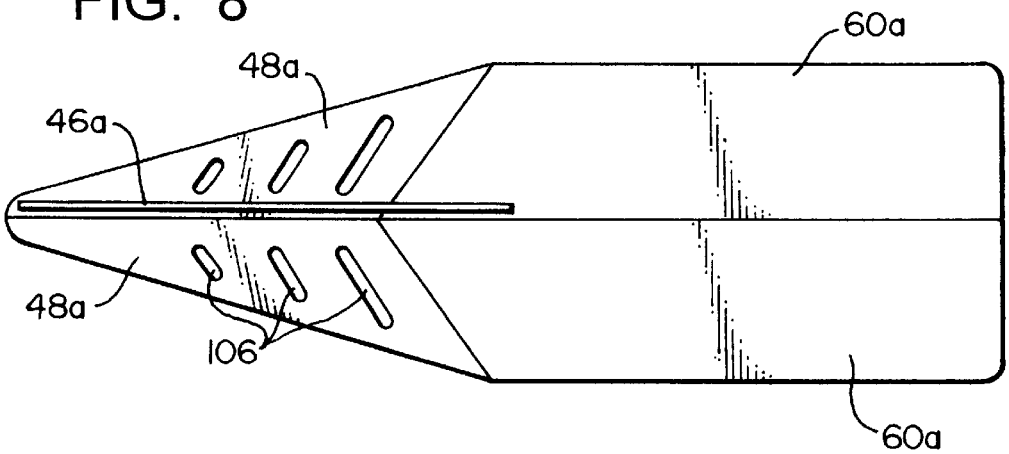
FIG. 8 is a top plan view of the second embodiment.
Figure 9:
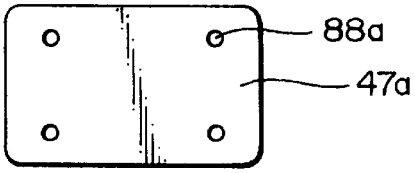
FIG. 9 is a plan view of the backing plate of the second embodiment.

To describe a second embodiment of the present invention, reference is now made to FIGS. 7, 8 and 9. Components of this second embodiment which are similar to components of the first embodiment will be given like numerical designations, with an "a" suffix distinguishing those that the second embodiment.

The overall configuration of this second embodiment is substantially at the same as the first embodiment. Thus, the apparatus 40*a* has the forward deflecting section 42*a* with the two deflecting plates 48*a,* the rear guard section 44*a* with the two guard plates 60*a*, the mounting plate 46*a,* and the backing plate 47*a*.

This second embodiment differs from the first embodiment in two respects. First, the holes 90 of the first embodiment are arranged somewhat differently in a pattern shown at 90*a* in FIG. 7. Second, there are several slots 106 formed in the two guard plates 48*a*. As can be seen in FIGS. 7 and 8, these slots 106 in a side elevational view are nearly horizontal but have a moderate upward and rearward slant. In the plan view of FIG. 8, it can be seen that these slots also have a lateral and rearward slant. It can be seen that the more forward slot 106 has a somewhat shorter dimension (matching the smaller lateral dimension of the plates 48*a* at that location), with the slots 106 increasing in length in a rearward direction, with the rearmost slot 106 being the longest.

While the hydrodynamic effect of the slots 106 cannot be fully ascertained, it is surmised that these provide for the flow of water therethrough to provide a desired hydrodynamic effect, by avoiding cavitation at the propeller location.

Figure 10:
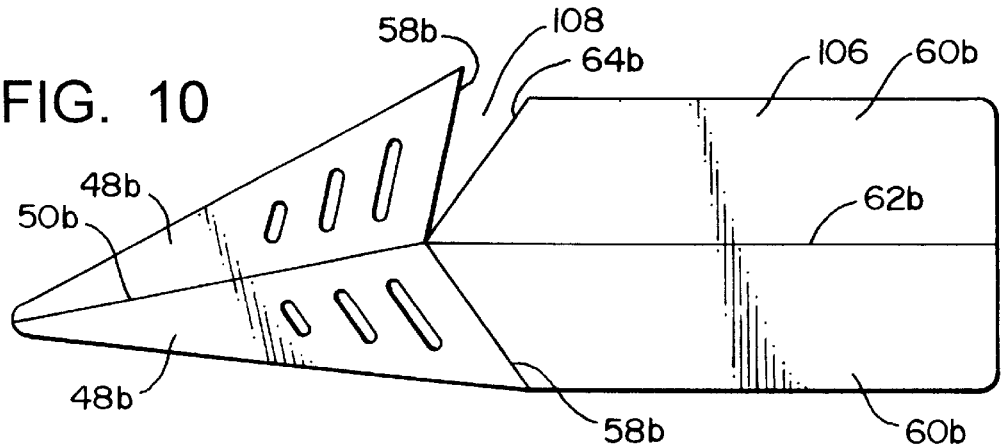
FIG. 10 is a top plan view of a single piece of sheet metal in its preformed condition, and also indicating the bend lines about which this metal sheet can be formed and welded to form the front and rear plate sections of the apparatus of the present invention.

With reference to FIG. 10, there will now be described a preferred manner in which the present invention can be manufactured. There is shown in FIG. 10 a flat piece of sheet metal 106 which has been cut or otherwise formed in the configuration shown in FIG. 10. In FIG. 10, this sheet metal piece 106 all lies in a single plane. For ease of description, the portions of this sheet 106 that correspond to components of the apparatus 40 in its finished form will be given numerical designations corresponding to those components of the first embodiment with a "b" suffix distinguishing the sections of the metal sheet piece 106. Thus, there are two forward plates 48*a* corresponding to the front deflector plates 48, and two rear plate sections 60*b* corresponding to the plates 60*a* of the second embodiment.

Also, it can be seen that there are three bend lines. First, there is a rear central longitudinally aligned bend line at the longitudinal center line 62*b*. Second, there is a forward bend line at 50*b* which is the location of the deflecting center line 50*a*. Third, there is a bend line at 58*b* which is at the left rear edge portion 58*a*. It can be seen that there is a triangular gap at 108, and this is on the two edges forming that gap comprise first the edge 58*b* that corresponds to the right edge line 58*a* and also a second edge line 64*b* corresponding to the right edge line 64*a* of the right guard plate 60*a*.

To form the metal piece 106 into the configuration of the apparatus 40*a* and 40 of the present invention, the metal piece 106 is bent along its bend lines 62*b*, 50*b* and 58*b* into the configuration shown in FIGS. 7 and 8. Then a weld is formed where the two edges 58*b* and 64*b* meet one another. After that, the mounting plate 46 or 46*a* is welded in place as described earlier herein.

Figure 11:
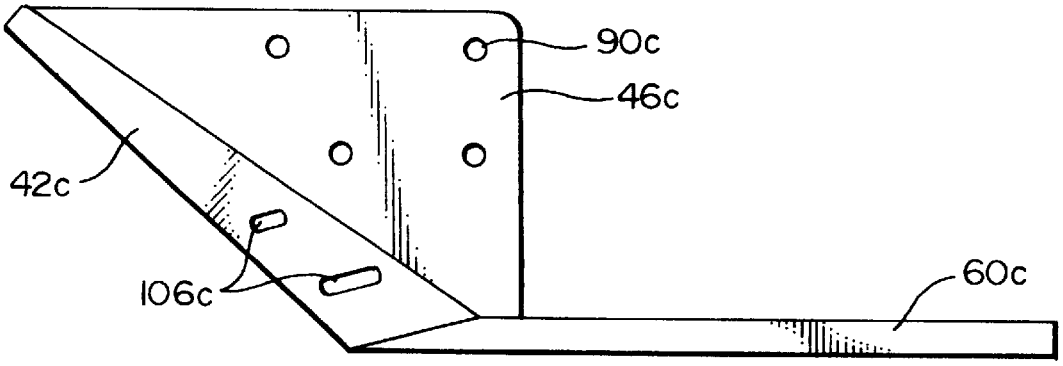
FIG. 11 is a side elevational view of a third embodiment, substantially similar to the second embodiment, but showing a different arrangement of the slots in the front section and also the positioning of the connecting holes.
Figure 12:
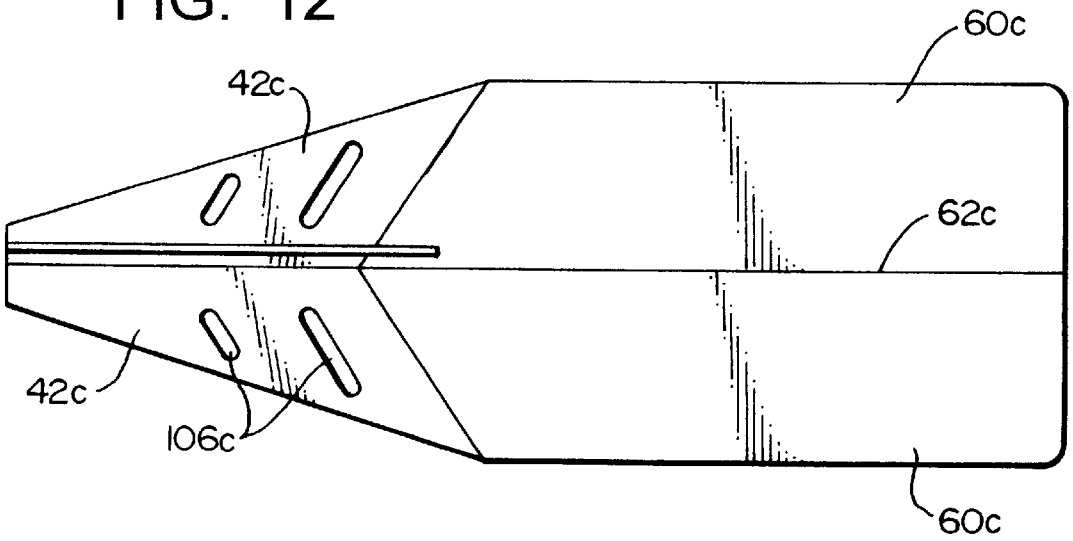
FIG. 12 is a top plan view of the third embodiment.
Figure 13:
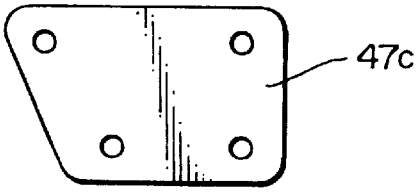
FIG. 13 is a plan view of the backing plate of the third embodiment.

A third embodiment of the present invention is shown in FIGS. 11, 12 and 13, which correspond to FIGS. 7, 8 and 9, respectively of the second embodiment. This third embodiment is substantially the same as the second embodiment, except that it is somewhat smaller, and there are only two slots corresponding with the slots 106 of the second embodiment. Also the arrangement of the backing plate is somewhat different.

Accordingly, there will be no further description of this third embodiment, and for purposes of identification, some of the main numerical designations of the second embodiment have been placed on the figures for this third embodiment with a "c" distinguishing those of the third embodiment.

It is obvious that various modifications could be made in the present invention without departing from the basic teachings thereof. For example, with reference to the first embodiment 56, while the front and rear sections 42 and 44 as shown each as being made of two flat plates having straight edge lines, there could be deviations from this. For example, the side edges 56 could be made with either a convex or concave curve. Also, the longitudinal centerline 50 could be made in an alignment which is different than a straight line. The same is true of the plates 60 of the rear section 44.

Further, while the mounting plate 46 and the backing plate 47 have been found to be particularly effective for accomplishing the mounting of the apparatus 40 in an economical manner, other mounting devices could be used. There could be multiple plates, possibly several struts, or another sub-connecting plane. Also, while the most convenient way of mounting the plate 46 or other mounting section that corresponds thereto is by mounting these directly to the skeg 18, other arrangements would be possible.

It is obvious that various modifications can be made without departing from the basic teachings of the present invention.

Therefore, I claim:

1. A protection and deflection apparatus that is adapted to be mounted in an operating position adjacent to a propeller section of a boat, the propeller section having a propeller blade portion having an axis of rotation and an outer circumferential path of rotation along which tip portions of the propeller blade portion travel, said apparatus having a longitudinal axis, a transverse axis and a vertical axis, said apparatus comprising:

a) a forwarding deflecting section having a forward central deflecting axis which extends in a downward and rearward slant, and comprising right and left deflection plates, each of which comprises:

i) a central deflection edge portion, with the two connecting deflection edge portions joining one another at said deflecting axis so as to form at the central deflecting axis a downwardly and rearwardly extending leading edge of the deflecting section;

ii) an outer deflection edge portion, with the two outer deflection edge portions each having a forward end and a rear end, and extending laterally outwardly and downwardly from the forward end of the deflection plate;

iii) a rear deflection section connecting portion;

iv) a generally downwardly and outwardly facing deflection surface, with the two deflection surfaces forming an angle of less than 180 degrees, relative to a plane taken perpendicular to said deflecting alignment axis, so as to extend laterally and upwardly away from one another and so as to extend rearwardly and divergently from said leading edge;

b) a rear guard section having a rear central guard section axis which is generally longitudinally aligned and is at an angle of less than 180 degrees relative to the deflection axis, a forward end portion connected to the rear end portion of the forward deflecting section and a rear end, said guard section comprising right and left guard plates, each of which comprises:

i) a central guard plate connecting edge portion with the two central guard plates connecting edge portions meeting each other at the central guard section axis;

ii) a laterally outward section edge portion having a forward end and a rear end;

iii) a forward guard section connecting portion connected to the rear deflection connecting portion of its related right or left deflection plate;

iv) a generally downwardly and outwardly facing lower guard surface, with the two guard surfaces forming an angle of less than 180 degrees, relative to a plane taken perpendicular to the guard section axis, whereby when said apparatus engages a bottom surface of particulate material in a shallow body of water, the forward deflecting section has a diverging action on said particulate material and downwardly and outwardly facing lower guard surfaces has a resisting action against the particulate material moving toward the central guard action axis.

2. The apparatus as recited in claim 1, wherein said apparatus further comprises a mounting section by which said apparatus can be mounted in said operating position.

3. The apparatus as recited in claim 2, wherein said mounting section comprises at least one vertically aligned mounting member adapted to be mounted to a skeg of the propeller section.

4. The apparatus as recited in claim 3, further comprising a backing plate which is adapted to be placed on a side of the skeg opposite to a side on which the mounting member is positioned, with one or more fasteners extending through said mounting member, said backing plate and said skeg.

5. The apparatus as recited in claim 1, wherein the forward deflecting section and the rear guard section are integrally formed from a single piece of sheet metal which is bent along bend lines to form the apparatus, said bend lines being located along said deflecting axis, along said central guard section axis, and along a connecting line between one of the deflection plates and one of the guard plates, with the other deflection plate and the other guard plate being joined together to form a unitary structure comprising the forward deflecting section and the rear guard section.

6. A method of providing protection and deflection for a propeller of a boat, said method comprising:

a) positioning a deflecting section forward of said propeller, where said deflecting section has a forward central deflecting axis which extends in a downward and rearward slant, and comprising right and left deflection plates, each of which comprises:

i) a central deflection edge portion, with the two connecting deflection edge portions joining one another at said deflecting axis;

ii) an outer deflection edge portion, with the two outer deflection edge portions each having a forward end and a rear end, and extending laterally outwardly and downwardly from the forward end of the deflection plate;

b) utilizing generally downwardly and outwardly facing deflection surfaces of the deflection plates to deflect objects or material from a path of the propeller;

c) providing a guard section beneath said propeller, said guard section having a central guard section axis which is generally longitudinally aligned and is at an angle of less than 180 degrees relative to the deflection axis, said guard section comprising right and left guard plates, each of which comprises:

i) a central guard plate connecting edge portion with the two central guard plates connecting edge portions meeting each other at the central guard section axis;

ii) a laterally outward section edge portion having a forward end and a rear end;

iii) a forward guard section connecting portion connected to the rear deflection connecting portion of its related right or left deflection plate;

d) utilizing generally downwardly and outwardly facing lower guard surfaces of the guard plates to protect the propeller from engagement with material and/or objects beneath and/or beside sand propeller.

7. A protection and deflection apparatus that is adapted to be mounted in an operating position adjacent to a propeller section of a boat, the propeller section having a propeller blade portion having an axis of rotation and an outer circumferential path of rotation along which tip portions of the propeller blade portion travel, said apparatus having a longitudinal axis, a transverse axis and a vertical axis, said apparatus comprising:

a) a forwarding deflecting section having a forward central deflecting axis which extends in a downward and rearward slant, and comprising right and left deflection plates, each of which comprises:

i) a central deflection edge portion, with the two connecting deflection edge portions joining one another at said deflecting axis so as to form at the central deflecting axis a downwardly and rearwardly extending leading edge of the deflecting section;

ii) an outer deflection edge portion, with the two outer deflection edge portions each having a forward end and a rear end, and extending laterally outwardly and downwardly from the forward end of the deflection plate;

iii) a rear deflection section connecting portion;

iv) a generally downwardly and outwardly facing deflection surface, with the two deflection surfaces forming an angle of less than 180 degrees, relative to a plane taken perpendicular to said deflecting alignment axis, so as to extend laterally and upwardly away from one another and so as to extend rearwardly and divergently from said leading edge;

b) a rear guard section having a rear central guard section axis which is generally longitudinally aligned and is at an angle of less than 180 degrees relative to the deflection axis, a forward end portion connected to the rear end portion of the forward deflecting section and a rear end, said guard section comprising right and left guard plates, each of which comprises:

i) a central guard plate connecting edge portion with the two central guard plates connecting edge portions meeting each other at the central guard section axis;

ii) a laterally outward section edge portion having a forward end and a rear end;

iii) a forward guard section connecting portion connected to the rear deflection connecting portion of its related right or left deflection plate;

iv) a generally downwardly and outwardly facing lower guard surface, with the two guard surfaces forming an angle of less than 180 degrees, relative to a plane taken perpendicular to the guard section axis, whereby when said apparatus engages a bottom surface of particulate material in a shallow body of water, the forward deflecting section has a diverging action on said particulate material and downwardly and outwardly facing lower guard surfaces has a resisting action against the particulate material moving toward the central guard action axis;

c) the angle formed by the two defection surfaces being no less than about a right angle.

8. The apparatus as recited in claim 7, wherein said angle formed by the deflection surfaces is between about 160 to 100 degrees.

9. A protection and deflection apparatus that is adapted to be mounted in an operating position adjacent to a propeller section of a boat, the propeller section having a propeller blade portion having an axis of rotation and an outer circumferential path of rotation along which tip portions of the propeller blade portion travel, said apparatus having a longitudinal axis, a transverse axis and a vertical axis, said apparatus comprising:

a) a forwarding deflecting section having a forward central deflecting axis which extends in a downward and rearward slant, and comprising right and left deflection plates, each of which comprises:

i) a central deflection edge portion, with the two connecting deflection edge portions joining one another at said deflecting axis so as to form at the central deflecting axis a downwardly and rearwardly extending leading edge of the deflecting section;

ii) an outer deflection edge portion, with the two outer deflection edge portions each having a forward end and a rear end, and extending laterally outwardly and downwardly from the forward end of the deflection plate;

iii) a rear deflection section connecting portion;

iv) a generally downwardly and outwardly facing deflection surface, with the two deflection surfaces forming an angle of less than 180 degrees, relative to a plane taken perpendicular to said deflecting alignment axis, so as to extend laterally and upwardly away from one another and so as to extend rearwardly and divergently from said leading edge;

b) a rear guard section having a rear central guard section axis which is generally longitudinally aligned and is at an angle of less than 180 degrees relative to the deflection axis, a forward end portion connected to the rear end portion of the forward deflecting section and a rear end, said guard section comprising right and left guard plates, each of which comprises:

i) a central guard plate connecting edge portion with the two central guard plates connecting edge portions meeting each other at the central guard section axis;

ii) a laterally outward section edge portion having a forward end and a rear end;

iii) a forward guard section connecting portion connected to the rear deflection connecting portion of its related right or left deflection plate;

iv) a generally downwardly and outwardly facing lower guard surface, with the two guard surfaces forming an angle of less than 180 degrees, relative to a plane taken perpendicular to the guard section axis, whereby when said apparatus engages a bottom surface of particulate material in a shallow body of water, the forward deflecting section has a diverging action on said particulate material and downwardly and outwardly facing lower guard surfaces has a resisting action against the particulate material moving toward the central guard action axis;

c) the angle formed by the two guard surfaces being no less than about two-thirds of a straight angle.

10. The apparatus as recited in claim 9, wherein the angle formed by the two guard surfaces is between about 150 to 175 degrees.

11. A protection and deflection apparatus that is adapted to be mounted in an operating position adjacent to a propeller section of a boat, the propeller section having a propeller blade portion having an axis of rotation and an outer circumferential path of rotation along which tip portions of the propeller blade portion travel, said apparatus having a longitudinal axis, a transverse axis and a vertical axis, said apparatus comprising:

a) a forwarding deflecting section having a forward central deflecting axis which extends in a downward and rearward slant, and comprising right and left deflection plates, each of which comprises:

i) a central deflection edge portion, with the two connecting deflection edge portions joining one another at said deflecting axis so as to form at the central deflecting axis a downwardly and rearwardly extending leading edge of the deflecting section;

ii) an outer deflection edge portion, with the two outer deflection edge portions each having a forward end and a rear end, and extending laterally outwardly and downwardly from the forward end of the deflection plate;

iii) a rear deflection section connecting portion;

iv) a generally downwardly and outwardly facing deflection surface, with the two deflection surfaces forming an angle of less than 180 degrees, relative to a plane taken perpendicular to said deflecting alignment axis, so as to extend laterally and upwardly away from one another and so as to extend rearwardly and divergently from said leading edge;

b) a rear guard section having a rear central guard section axis which is generally longitudinally aligned and is at an angle of less than 180 degrees relative to the deflection axis, a forward end portion connected to the rear end portion of the forward deflecting section and a rear end, said guard section comprising right and left guard plates, each of which comprises:

i) a central guard plate connecting edge portion with the two central guard plates connecting edge portions meeting each other at the central guard section axis;

ii) a laterally outward section edge portion having a forward end and a rear end;

iii) a forward guard section connecting portion connected to the rear deflection connecting portion of its related right or left deflection plate;

iv) a generally downwardly and outwardly facing lower guard surface, with the two guard surfaces forming an angle of less than 180 degrees, relative to a plane taken perpendicular to the guard section axis, whereby when said apparatus engages a bottom surface of particulate material in a shallow body of water, the forward deflecting section has a diverging action on said particulate material and downwardly and outwardly facing lower guard surfaces has a resisting action against the particulate material moving toward the central guard action axis.

c) the outer deflection edge portions of the two deflection plates forming an angle between about a right angle and about one-sixth of a right angle taken from a view parallel to the longitudinal center axis of the apparatus.

12. A protection and deflection apparatus that is adapted to be mounted in an operating position adjacent to a propeller section of a boat, the propeller section having a propeller blade portion having an axis of rotation and an outer circumferential path of rotation along which tip portions of the propeller blade portion travel, said apparatus having a longitudinal axis, a transverse axis and a vertical axis, said apparatus comprising:

a) a forwarding deflecting section having a forward central deflecting axis which extends in a downward and rearward slant, and comprising right and left deflection plates, each of which comprises:

i) a central deflection edge portion, with the two connecting deflection edge portions joining one another at said deflecting axis so as to form at the central deflecting axis a downwardly and rearwardly extending leading edge of the deflecting section;

ii) an outer deflection edge portion, with the two outer deflection edge portions each having a forward end and a rear end, and extending laterally outwardly and downwardly from the forward end of the deflection plate;

iii) a rear deflection section connecting portion;

v) a generally downwardly and outwardly facing deflection surface, with the two deflection surfaces forming an angle of less than 180 degrees, relative to a plane taken perpendicular to said deflecting alignment axis, so as to extend laterally and upwardly away from one another and so as to extend rearwardly and divergently from said leading edge;

b) a rear guard section having a rear central guard section axis which is generally longitudinally aligned and is at an angle of less than 180 degrees relative to the deflection axis, a forward end portion connected to the rear end portion of the forward deflecting section and a rear end, said guard section comprising right and left guard plates, each of which comprises:

i) a central guard plate connecting edge portion with the two central guard plates connecting edge portions meeting each other at the central guard section axis;

ii) a laterally outward section edge portion having a forward end and a rear end;

iii) a forward guard section connecting portion connected to the rear deflection connecting portion of its related right or left deflection plate;

iv) a generally downwardly and outwardly facing lower guard surface, with the two guard surfaces forming an angle of less than 180 degrees, relative to a plane taken perpendicular to the guard section axis, whereby when said apparatus engages a bottom surface of particulate material in a shallow body of water, the forward deflecting section has a diverging action on said particulate material and downwardly and outwardly facing lower guard surfaces has a resisting action against the particulate material moving toward the central guard action axis, c) said apparatus being characterized in that a horizontal plane intersecting the two guard plates at about the longitudinal mid length thereof defining two horizontal lines extending rearwardly and outwardly from the forward central deflecting axis at an angle between about three-quarters of a straight angle and one-half of a right angle.

13. A protection and deflection apparatus that is adapted to be mounted in an operating position adjacent to a propeller section of a boat, the propeller section having a propeller blade portion having an axis of rotation and an outer circumferential path of rotation along which tip portions of the propeller blade portion travel, said apparatus having a longitudinal axis, a transverse axis and a vertical axis, said apparatus comprising:

a) a forwarding deflecting section having a forward central deflecting axis which extends in a downward and rearward slant, and comprising right and left deflection plates, each of which comprises:

i) a central deflection edge portion, with the two connecting deflection edge portions joining one another at said deflecting axis so as to form at the central deflecting axis a downwardly and rearwardly extending leading edge of the deflecting section;

ii) an outer deflection edge portion, with the two outer deflection edge portions each having a forward end and a rear end, and extending laterally outwardly and downwardly from the forward end of the deflection plate;

iii) a rear deflection section connecting portion;

iv) a generally downwardly and outwardly facing deflection surface, with the two deflection surfaces forming an angle of less than 180 degrees, relative to a plane taken perpendicular to said deflecting alignment axis, so as to extend laterally and upwardly away from one another and so as to extend rearwardly and divergently from said leading edge;

b) a rear guard section having a rear central guard section axis which is generally longitudinally aligned and is at an angle of less than 180 degrees relative to the deflection axis, a forward end portion connected to the rear end portion of the forward deflecting section and a rear end, said guard section comprising right and left guard plates, each of which comprises:

i) a central guard plate connecting edge portion with the two central guard plates connecting edge portions meeting each other at the central guard section axis;

ii) a laterally outward section edge portion having a forward end and a rear end;

iii) a forward guard section connecting portion connected to the rear deflection connecting portion of its related right or left deflection plate;

v) a generally downwardly and outwardly facing lower guard surface, with the two guard surfaces forming an angle of less than 180 degrees, relative to a plane taken perpendicular to the guard section axis, whereby when said apparatus engages a bottom surface of particulate material in a shallow body of water, the forward deflecting section has a diverging action on said particulate material and downwardly and outwardly facing lower guard surfaces has a resisting action against the particulate material moving toward the central guard action axis, c) the angle formed by the central guard section axis relative to the deflection axis being no less than about two-thirds of a straight angle.

14. The apparatus as recited in claim 13, wherein the angle formed by the rear central guard section axis and the deflection axis is between about 160 degrees to about three-quarters of a straight angle.

15. A protection and deflection apparatus that is adapted to be mounted in an operating position adjacent to a propeller section of a boat, the propeller section having a propeller blade portion having an axis of rotation and an outer circumferential path of rotation along which tip portions of the propeller blade portion travel, said apparatus having a longitudinal axis, a transverse axis and a vertical axis, said apparatus comprising:

a) a forwarding deflecting section having a forward central deflecting axis which extends in a downward and rearward slant, and comprising right and left deflection plates, each of which comprises:

i) a central deflection edge portion, with the two connecting deflection edge portions joining one another at said deflecting axis so as to form at the central deflecting axis a downwardly and rearwardly extending leading edge of the deflecting section;

ii) an outer deflection edge portion, with the two outer deflection edge portions each having a forward end and a rear end, and extending laterally outwardly and downwardly from the forward end of the deflection plate;

iii) a rear deflection section connecting portion;

iv) a generally downwardly and outwardly facing deflection surface, with the two deflection surfaces forming an angle of less than 180 degrees, relative to a plane taken perpendicular to said deflecting alignment axis, so as to extend laterally and upwardly away from one another and so as to extend rearwardly and divergently from said leading edge;

b) a rear guard section having a rear central guard section axis which is generally longitudinally aligned and is at an angle of less than 180 degrees relative to the deflection axis, a forward end portion connected to the rear end portion of the forward deflecting section and a rear end, said guard section comprising right and left guard plates, each of which comprises:

i) a central guard plate connecting edge portion with the two central guard plates connecting edge portions meeting each other at the central guard section axis;

ii) a laterally outward section edge portion having a forward end and a rear end;

iii) a forward guard section connecting portion connected to the rear deflection connecting portion of its related right or left deflection plate;

v) a generally downwardly and outwardly facing lower guard surface, with the two guard surfaces forming an angle of less than 180 degrees, relative to a plane taken perpendicular to the guard section axis, whereby when said apparatus engages a bottom surface of particulate material in a shallow body of water, the forward deflecting section has a diverging action on said particulate material and downwardly and outwardly facing lower guard surfaces has a resisting action against the particulate material moving toward the central guard action axis.

c) the forward deflecting section being made with through openings to permit water to flow rearwardly through said deflection section toward a propeller location with the apparatus in its operating position.

16. The apparatus as recited in claim 15, wherein said openings comprise elongate slots having substantial horizontal alignment components and formed in each of said deflection plates.

17. A protection and deflection apparatus that is adapted to be mounted in an operating position adjacent to a propeller section of a boat, the propeller section having a propeller blade portion having an axis of rotation and an outer circumferential path of rotation along which tip portions of the propeller blade portion travel, said apparatus having a longitudinal axis, a transverse axis and a vertical axis, said apparatus comprising:

a) a forwarding deflecting section having a forward central deflecting axis which extends in a downward and rearward slant, and comprising right and left deflection plates, each of which comprises:

i) a central deflection edge portion, with the two connecting deflection edge portions joining one another at said deflecting axis so as to form at the central deflecting axis a downwardly and rearwardly extending leading edge of the deflecting section;

ii) an outer deflection edge portion, with the two outer deflection edge portions each having a forward end and a rear end, and extending laterally outwardly and downwardly from the forward end of the deflection plate;

iii) a rear deflection section connecting portion;

iv) a generally downwardly and outwardly facing deflection surface, with the two deflection surfaces forming an angle of less than 180 degrees, relative to a plane taken perpendicular to said deflecting alignment axis, so as to extend laterally and upwardly away from one another and so as to extend rearwardly and divergently from said leading edge;

b) a rear guard section having a rear central guard section axis which is generally longitudinally aligned and is at an angle of less than 180 degrees relative to the deflection axis, a forward end portion connected to the rear end portion of the forward deflecting section and a rear end, said guard section comprising right and left guard plates, each of which comprises:

i) a central guard plate connecting edge portion with the two central guard plates connecting edge portions meeting each other at the central guard section axis;

ii) a laterally outward section edge portion having a forward end and a rear end;

iii) a forward guard section connecting portion connected to the rear deflection connecting portion of its related right or left deflection plate;

iv) a generally downwardly and outwardly facing lower guard surface, with the two guard surfaces forming an angle of less than 180 degrees, relative to a plane taken perpendicular to the guard section axis, whereby when said apparatus engages a bottom surface of particulate material in a shallow body of water, the forward deflecting section has a diverging action on said particulate material and downwardly and outwardly facing lower guard surfaces has a resisting action against the particulate material moving toward the central guard action axis, c) forward end portions of the downwardly facing guard surfaces of the two guard plates being aligned and adjacent to rear end portions of the downwardly facing deflection surfaces of the deflection plates; and the forward portions of the downwardly facing guard surfaces slanting inwardly and forwardly toward one another and form an angle between about 160 and 60 degrees.

18. The apparatus as recited in claim 17, wherein forward lower surface edge portions of the guard plates are aligned with and immediately adjacent to rear surface edge portions of the deflection plates in a manner to form a continuous lower surface area of the deflection section and the guide section.

19. The apparatus as recited in claim 18, wherein outer edges of the outer deflection edge portions of the deflection plates meet forward ends of outer edges of the guard plates.

* * * * *